US005603120A

United States Patent [19]

Gifford

[11] Patent Number: 5,603,120

[45] Date of Patent: Feb. 18, 1997

[54] HEADGEAR DISPLAY ATTACHMENT AND METHOD OF MANUFACTURE

[75] Inventor: Mark Gifford, Houston, Tex.

[73] Assignee: Apogee Enterprises, Inc., Houston, Tex.

[21] Appl. No.: 521,270

[22] Filed: Aug. 30, 1995

[51] Int. Cl.[6] ..... A42B 1/06

[52] U.S. Cl. ..... 2/172; 2/209.13

[58] Field of Search ..... 2/172, 171, 181, 2/181.2, 181.4, 205, 206, 207, 209.13, 410, 422, 423, 416, 417, 418, 918, 901

[56] References Cited

U.S. PATENT DOCUMENTS

| | | | |
|---|---|---|---|
| 2,144,870 | 1/1939 | Bullard | 2/410 |
| 2,967,304 | 1/1961 | Austin | 2/417 |
| 3,166,766 | 1/1965 | Banello, Jr. | 2/175.6 |
| 5,046,195 | 9/1991 | Koritan . | |
| 5,048,128 | 9/1991 | Watson, Jr. . | |
| 5,081,717 | 1/1992 | Shedd et al. . | |
| 5,161,259 | 11/1992 | Shorts | 2/171 |
| 5,212,837 | 5/1993 | Gose et al. | 2/172 |
| 5,355,535 | 10/1994 | Brunder | 2/171 |
| 5,448,778 | 9/1995 | Phillips | 2/172 |
| 5,493,734 | 2/1996 | Nieves-Rivera | 2/172 |

*Primary Examiner*—C. D. Crowder
*Assistant Examiner*—Larry D. Worrell, Jr.
*Attorney, Agent, or Firm*—Vaden, Eickenroht & Thompson, L.L.P.

[57] ABSTRACT

An attachment for a headgear having a flap depending therefrom to display an image and also providing a sun shield for the neck of the wearer. The attachment includes a flat strip that is preferably extruded from low density polyethylene material. Thus, it is pliable with plastic memory so that it tries to straighten out when curled in a suitable arc for matching the contour of a hatband. For headgear having a standard hatband, slitted tabs at opposite ends of the strip are separated so that the U-shaped tongue of each tab goes over the top of the hatband into the pocket therebehind. The attachment can also be secured to the webbing of a hard hat by slipping webbing straps through the slitted tab ends of the attachment strip. No special connection parts are required to be included in the headgear and the attachment is not size sensitive, but can be used in almost any size of headgear.

29 Claims, 3 Drawing Sheets

FIG. 1
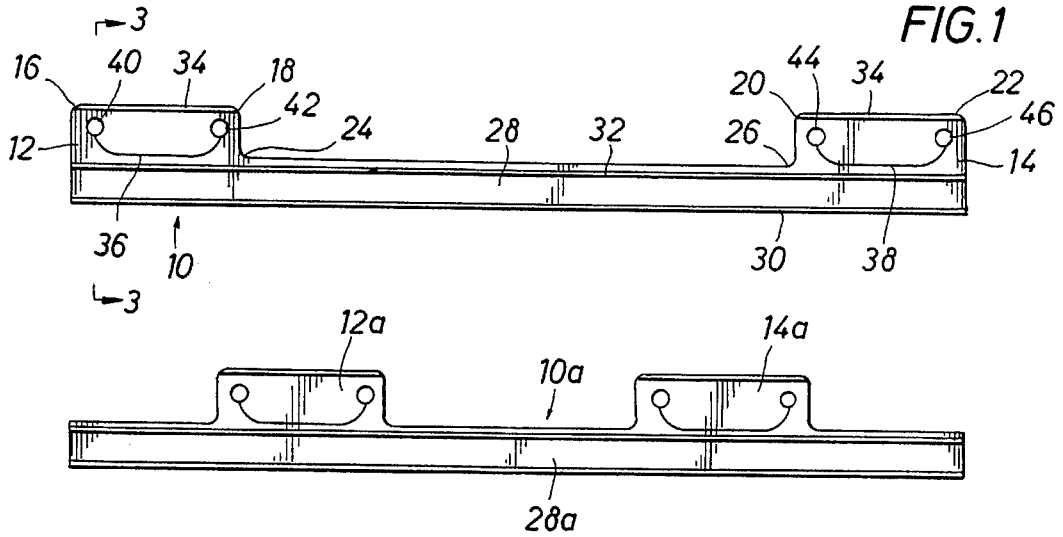
FIG. 2
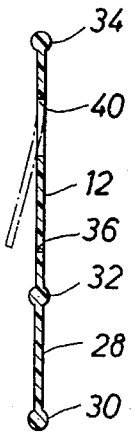
FIG. 3
FIG. 4a
FIG. 4b
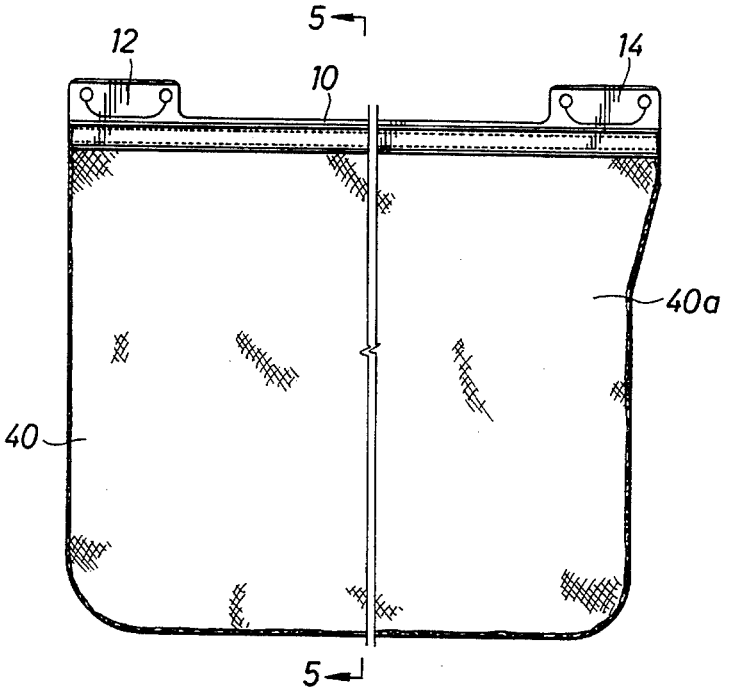
FIG. 5
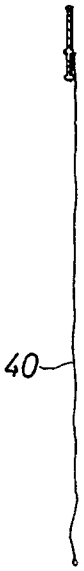
FIG. 6
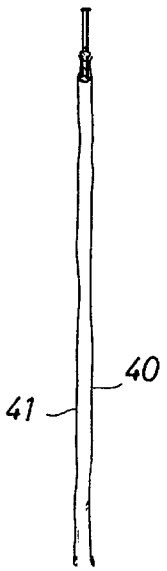

FIG.10
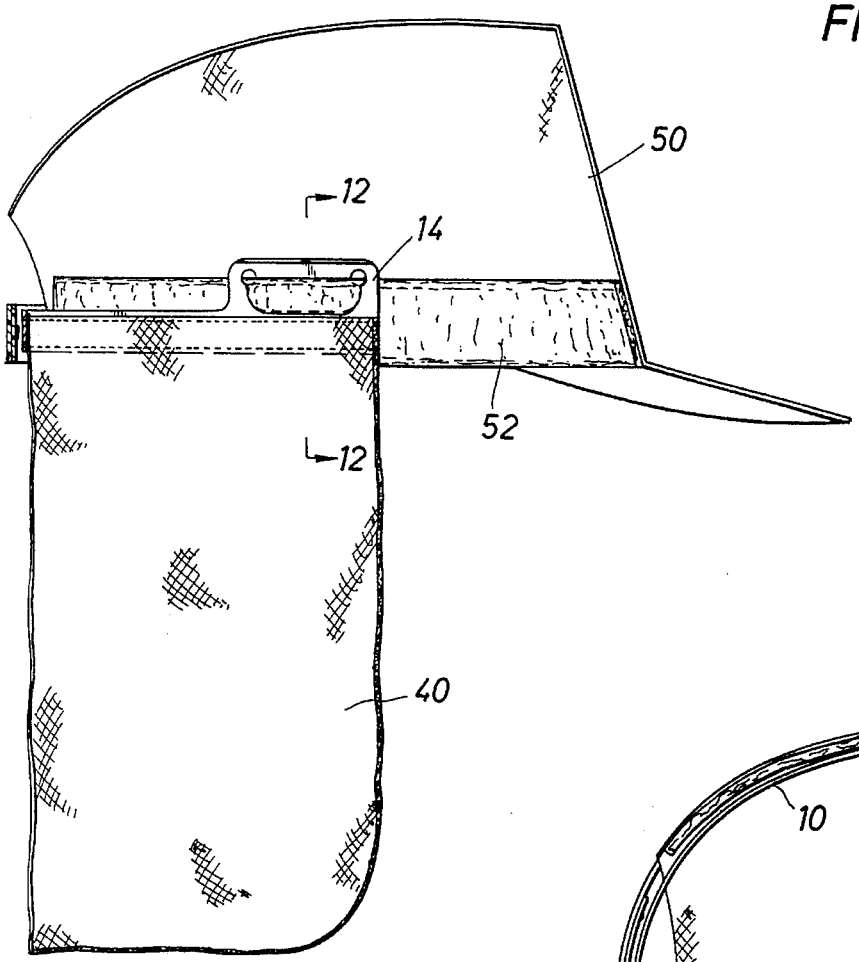
FIG.11
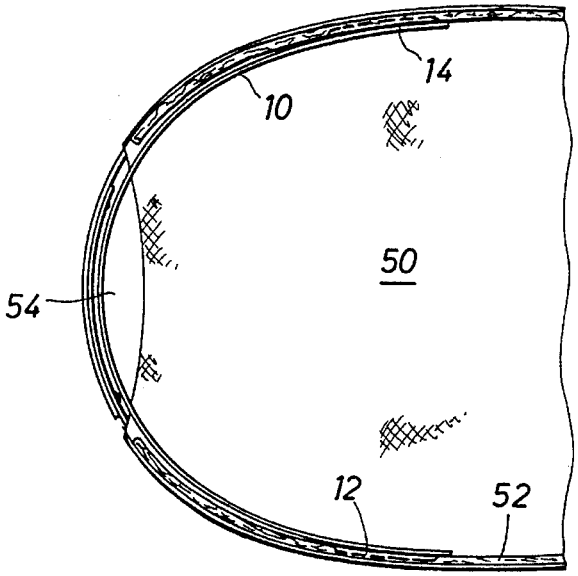
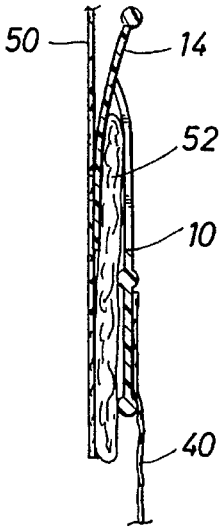
FIG.12

HEADGEAR DISPLAY ATTACHMENT AND METHOD OF MANUFACTURE

BACKGROUND OF THE INVENTION

1. Field of Invention

This invention pertains to an attachment for a headgear for protecting the wearer against the sun and for displaying an image such as a logo or a slogan and, more specifically, to such an attachment that is universally sized and does not depend on aligned Velcro pads, snaps or buttons on the headgear and the attachment.

2. Description of the Prior Art

Baseball style caps and other headgear are often worn to display commercial slogans, logos and the like and/or the slogans, logos and the like of athletic teams, clubs and volunteer organizations of all types. Such headgear are sometimes bought and at other times are given away as promotional material or for other purposes. It is not uncommon for persons to have collected a large number of such caps or other hats over a period of time since each message that the wearer desires to present or display requires a different cap or hat. If the wearer is purchasing each separate headgear, it has cost the wearer quite a bit of money since headgear can be quite expensive. When promotional caps or the like are given away in quantity, the expense of such a giveaway program can be quite substantial for the promoter.

The principal alternative to caps of the type just described has been T-shirts, which themselves are not inexpensive. Moreover, each time the wearer desires to convey a different message, the wearer must purchase or be given a new T-shirt.

It is not uncommon for a wearer of a cap or a T-shirt to display more than one message at a given event. For example, the wearer may be attending a championship game and want to urge victory over the foe on behalf of the team he or she supports at the beginning of the game. However, if the team being supported wins the game, immediately the wearer wants to announce a message that the winning team is now champion. To do that with conventional caps or T-shirts, the wearer must change the apparel to change the message.

In desert environments and/or when working or otherwise staying out-of-doors in the blazing sun, wearers of headgear do so in such conditions at least in part to protect the top of their heads from sun burn and other effects of the sun and heat. However, in order to protect the back of the neck, or other areas of exposed skin, it is necessary to use a cover or shield in addition to the conventional headgear. One type of such covering has been a hat flap that covers the back of the neck and the like. Such flaps in the prior art have either been permanently sewn or otherwise attached or have utilized attachment means that are related to the size of the headgear.

Of this latter type, removable hat flaps have included either buttons or button holes so that the flap can be secured at least two locations, the male or female part of snaps for the same purpose, half of a zipper, or half of a set of Velcro patches. Each of the above attachment mechanisms has to have a compatible part that is a permanent part of the headgear. Of course, ordinary headgear do not come with such parts or components. Moreover, if these parts are affixed to the hatband of a headgear, the attachment mechanisms have an appreciable dimension that forms uncomfortable lumps against the head of the wearer that are unacceptable. Therefore, except for the headgear that have the permanently installed flaps, none of the removable flaps described above have met with any substantial commercial acceptance. The permanently installed flaps are not universally available because many times the headgear wearer does not want to wear the flap down, does not want to wear the flap up in the crown of the hat, and does not want to spend the extra money to buy a hat with a flap that is only worn utilizing the flap feature a small portion of the time.

Therefore, it is a feature of the present invention to provide an improved headgear display attachment that can be attached to a standard cap or other headgear without special attachment features on the headgear itself.

It is another feature of the present invention to provide an improved headgear display attachment for hanging down as a sun-shielding, neck-protecting flap that is universally sized to fit almost all caps or other headgear.

It is still another feature of the present invention to provide an improved headgear display attachment that is attachable to a cap or hat with an upturned hatband or that employs a suspension webbing, such as a hard hat.

It is yet another feature of the present invention to provide an improved headgear that is reversible or that employs two flaps for readily displaying a first message and subsequently displaying a second message without having to change headgear.

SUMMARY OF THE INVENTION

Normally, a soft cap or a hat includes a hatband that is turned up inside the headgear. Sometimes such a hatband is referred to as a sweat band or a headband. Such a hatband is securely attached to all or a large periphery of the hat and, when turned up, forms a pocket with a top opening behind the hatband. The attachment disclosed herein preferably includes a strip of flat, flexible and pliable material that tends to straighten out when put in a curled condition. The strip is sufficiently long so as to fit around a substantial portion of the periphery of the headgear. Preferably, the length of the strip is between one-quarter and one-half of the circumferential dimension of the hatband and its width in its center region is approximately the same width or slightly less than the width of the typical hatband. Two tabs at or near the ends of the strip extend upwardly from the center region of the strip at a distance approximately the same as or slightly more than the width of the center region of the strip. Thus, at these tabs, the strip is approximately twice the width of the typical hatband.

Each of the tabs includes a U-shaped slit to form a downwardly directed tongue. To place the attachment into the headgear, the strip is curled to the approximate arc of the hatband and the tongues are pressed inwardly to tuck over and behind the top of the hatband into the pocket formed between the hatband and the crown or the headcovering portion of the headgear. The straightening bias of the curled strip is uniform to hold the strip in place without putting noticeable end pressure on the head of the wearer.

A flap, usually with a design or image such as a slogan, logo or the like, is attached to the strip to hang down therefrom to become a sun screen for the wearer's neck. The design is thereby also put on display for observers behind the wearer. The flap is typically made of double-knit stretchable fabric that is biased to have its primary stretch direction transverse to the elongate dimension of the strip.

The preferred embodiment of the strip is extruded of low density polyethylene and includes a bead or rib along or near the bottom edge of the strip and a similar bead or rib along or near the top edge of the center region of the strip and which extends through the tab areas. The flap is sewn or glued to the strip in the area between these two beads or ribs.

Also, preferably, another bead is included along or near the top edge of the tabs and the ends of the U-shaped slits terminate in the center of circular holes. These holes and tab beads help prevent tear-out of the slits through the tabs and aids in setting the tongues of the tabs behind the hatband.

Alternative to the simple one-layer flap, a second side of the flap or a second flap may be attached to the same or backside of the strip for including a second image design. Thus, to display the second image, the strip is simply removed from the hatband and turned around. When not on display, in the case of two flaps, one of these flaps may be tucked into the inside against the top of the headgear. Also, a flap may include an ice pocket to hold an ice pack or cool pack for the additional comfort of the wearer.

The attachment strip just described may be used in conjunction with a hard hat or other headgear having an inside suspension webbing rather than the typical hatband. Such webbing includes web straps that are releasable at one of their ends, which ends can then be threaded through the U-shaped slits of the tabs and re-attached to the webbing. The tabs have to be compatibly located with respect to the releasable web straps for this usage.

The strip, when used with a headgear having an ordinary hatband, is not restricted in size, but will fit headgear of almost any size. Also, there is an absence of any special attachment means to the headgear so the attachment can be marketed separately from any particular headgear. Moreover, since the attachment of the invention is universally attachable to almost any headgear, it can be used over and over again as the wearer desires with a variety of headgear.

The described plastic strip and fabric flap is anticipated to be preferred in most cases; however, alternatively for one-time or limited use, the strip can be made from layered cardboard or corrugated paper having the desirable pliable qualities described above. The flap also may be plastic or even paper, if desired. When fabric flaps are used, they are typically serged along their entire edge, which also may be sculptured to form an aesthetic shape, if desired.

BRIEF DESCRIPTION OF THE DRAWINGS

So that the manner in which the above recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the drawings illustrate only preferred embodiments of the invention and are therefore not to be considered limiting of its scope as the invention may admit to other equally effective embodiments. In the drawings:

FIG. 1 is a front view of a preferred embodiment of the strip in accordance with the present invention.

FIG. 2 is a front view of an alternate embodiment of a strip in accordance with the present invention.

FIG. 3 is a cross-sectional side view of the strip shown in FIG. 1 taken at line 3—3.

FIG. 4*a* is a front cutaway view of a strip having a flap attached thereto that is generally rectangular in shape.

FIG. 4*b* is a front cutaway view of a strip having a flap attached thereto that is generally irregular in shape for aesthetic purposes.

FIG. 5 is a cross-sectional side view of a display attachment in accordance with the present invention taken at line 5—5 of FIG. 4*a*.

FIG. 6 is a side view of a display attachment including two flaps for displaying one of two images present on the respective flaps.

FIG. 10 is a cross-sectional side view of a headgear to which a display attachment in accordance with the present invention is attached.

FIG. 11 is a bottom view of the headgear and display attachment shown in FIG. 10.

FIG. 12 is a cross-sectional view of the hatband and strip of a display attachment taken at 12—12 of FIG. 10.

DESCRIPTION OF THE PREFERRED EMBODIMENTS

Figure 7:
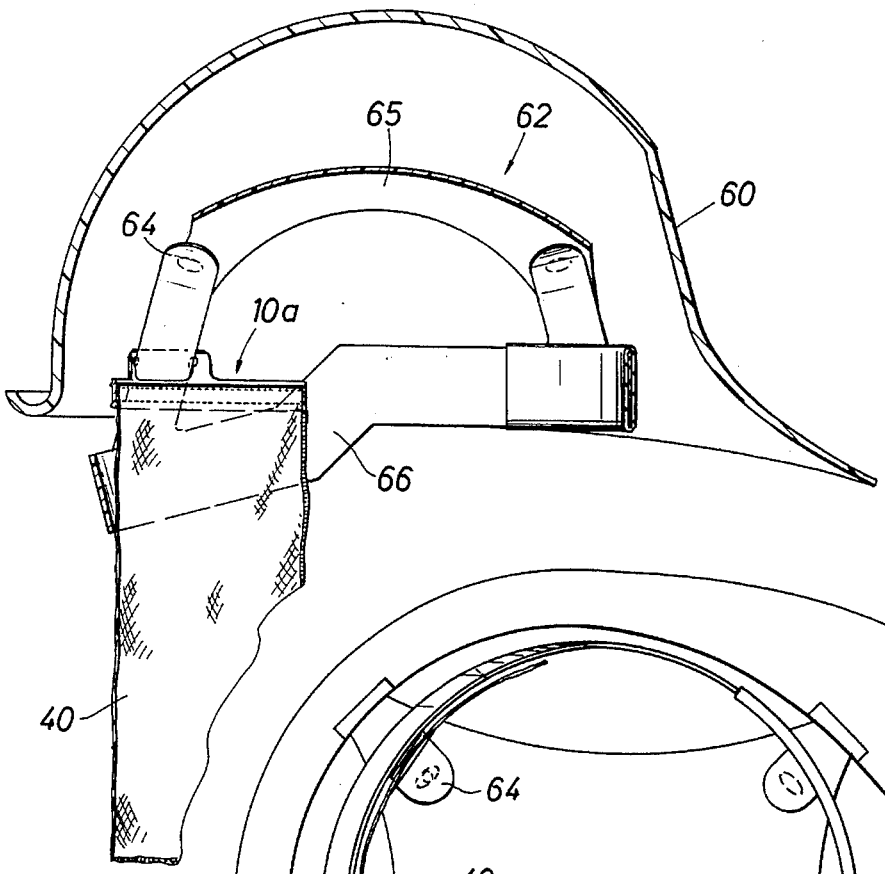
FIG. 7 is a cross-sectional side view of a hard hat to which is secured a display attachment in accordance with the present invention.

Now referring to the drawings, and first to FIG. 1, an attachment strip 10 is shown in accordance with the present invention. Strip 10 is preferably made of plastic material that is extruded to have a sideways profile such as that shown in FIG. 3. A strip material that is preferred is low density polyethylene. An acceptable length of strip is 11¾ inches, which allows the strip to be accommodated in most headgear of the type described herein that are sized to be worn by grown children and adults. Strips of a lesser length are suitable to be accommodated in headgear worn by small children. The strip is normally about 1¼ inches wide and about ⅛ inch thick, which allows it to be easily curled into a broad arc in handling so that it can be inserted into a headgear in the manner hereafter described. The length suggested is preferred, but any length sufficient to cover one-quarter to one-half of the periphery of the headgear is satisfactory.

Upwardly extending tabs 12 and 14 are formed by stamping or cutting the originally extruded strip at or near either end of the strip. A preferred length of each of the tabs is 2 inches, although tabs can vary greatly from that length and still function in an acceptable manner. The top corners 16, 18, 20 and 22 of the tabs are slightly curved, preferably at about a ¼ inch radius. The tabs are also slightly curved in a similar radius at each of curves 24 and 26, respectively, where the tabs are formed upwardly from the elongate center and remaining region or body 28 of the strip.

Along or near the bottom edge of the strip, a bead or rib 30 is formed so that the thickness dimension at the rib is about twice the thickness of the non-ribbed portion of the strip. Along or near the top edge of body 28 an intermediate parallel rib 32 of similar dimension to the bottom rib is made during the extrusion process. This rib extends the full length of the strip, including under each tab 12 and 14. A top rib 34 is formed in similar fashion along or near the top edge of each tab 12 and 14. The width of each of the tabs from its top edge and including intermediate rib 32 is preferably ¾ inch, which makes center region 28 slightly smaller in width than the tab width.

A U-shaped slit 36 is made in tab 12 and a similar slit 38 is made in tab 14 to thereby produce downwardly directed tongues therein for holding the attachment strip to a headgear, as hereafter described. The ends of each U-shaped slit terminate in the center of a hole punched or cut into the tab. These holes 40, 42, 44 and 46 are preferably round, but may be made of a different shape, if desired. The side view of the strip just described is shown in FIG. 3, which shows a tongue being formed in dotted lines when it is pressed outwardly from the tab during use.

These holes help prevent the slits from tearing out of the tabs and also allows the tongues of the tabs to be pressed downwardly to complete their seating behind the hatband, regardless of the thickness of the hatband. Moreover, the holes prevent the plastic memory of the strip that tends to close the slits when the tongues are pressed outwardly from causing the strip to ride up on the hatband.

Now turning to FIGS. 4*a* and 4*b*, the use of a strip 10 is shown connected to a suitable flap, which may be of alternate shapes as shown in the two illustrations. The flap or drape is typically made of soft cotton material, such as stretchable double-knit cotton material, or a polyester cotton blend, and includes an image to be displayed when the attachment is attached to a headgear. Typically, the flap also helps in providing protection of the wearer's neck from the sun in addition to displaying the image.

A flap 40 may be generally rectangular, as shown in FIG. 4*a*, or may be desirably aesthetically shaped in a contour, as shown in FIG. 4*b*. The top edge of the flap is straight, however, and is sized to be approximately the same length as the strip. The top edge of the flap is positioned so that it is then attached by a convenient manner to that portion of the strip between the lower or bottom rib and the intermediate rib. The attachment of the flap to the strip is achieved preferably by sewing or gluing; however, with only a little additional structure the flap could be attached to the strip by a Velcro attachment, a zipper or any other convenient means.

A preferred method of finishing the flap is to form and bind the edge to prevent fraying. One convenient technique that can be used is known as "serging" which is a combination procedure of cutting the edge in the desired shape and sewing the edge with a wrapping stitch. The edge can be effectively sealed by any other convenient procedure.

After the flap is finished, the flap can then be silk-screened or otherwise treated to impart an image thereto, which may be done immediately following the making of the flap or at a later time and at a different place.

FIG. 10 is a cutaway view of a headgear 50, which can be a baseball type cap, a straw hat or any other headgear that includes a conventional hatband 50 around all or a major portion of its inside periphery. Such a hatband is affixed to the headgear at its lower edge and is upturned inside the headgear, thereby forming a pocket behind the hatband and the inside surface of the headgear.

To attach the attachment including the strip and its flap, the tongue in one of the tabs is pressed inwardly to allow the tongue to fit over and into the pocket behind the hatband. The strip is then gently curved to fit the other tab in proximity to the hatband at the appropriate location for the flap secured to the strip to hang down, as desired. The tongue of this second tab is pressed inwardly in the manner just described for the first tab and the tongue is placed behind the hatband. A slight downward tug on the flap assures that the strip is positioned as shown in FIG. 10, namely, aligned along the hatband.

It is noted that the attachment just described uses no Velcro fasteners, zippers, buttons or other means not normally a part of any headgear with a hatband. Thus, the headgear attachment can be universally attached to any such headgear, as desired. Also, headgear of almost any size can accept such a headgear attachment. This means, for example, adjustable baseball caps can be sized appropriately for the individual wearer without worrying whether the headgear attachment will fit. This adjustability of headgear size is illustrated in FIG. 11, which also shows that the attachment fits into a headgear which has an open area 54 at its rear to provide for hat sizing and therefore does not have a complete hatband.

Figure 8:
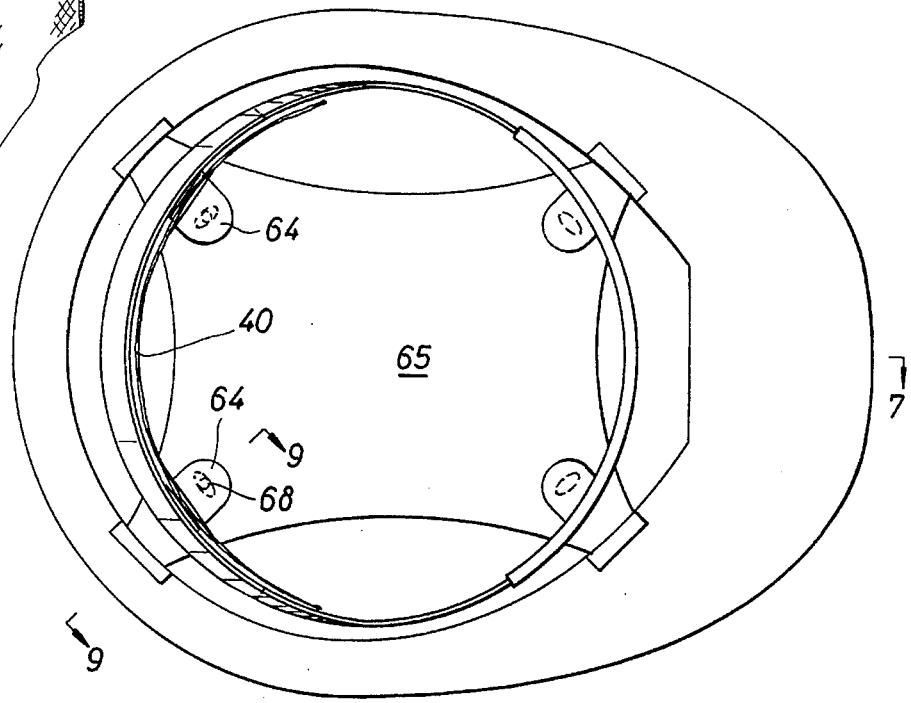
FIG. 8 is a bottom view of the hard hat and display attachment shown in FIG. 7.
Figure 9:
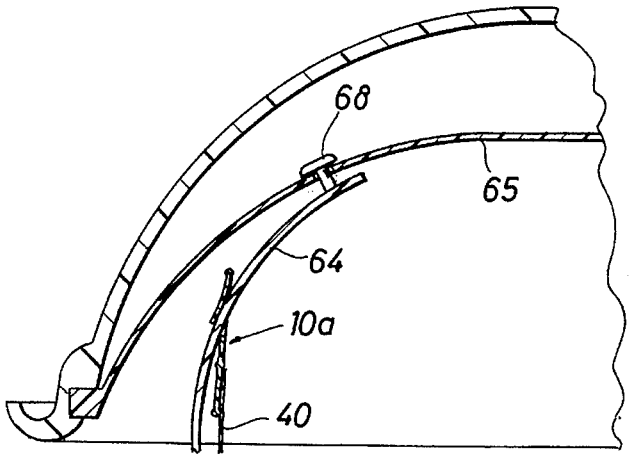
FIG. 9 is a partial cross-sectional view of the location of a display attachment with respect to the webbing of the hard hat shown in FIG. 8.

Not all headgear have a hatband of the type just described, however. FIGS. 7–9 illustrate a hard hat 60 having a webbing suspension 62 therein. Such a webbing typically includes webs 64 at four or six or more locations attached to a head band 66. These webs are each releasable at one end to the top portion or crown 65 of the webbing, such as by snaps or the like as shown at connections 68. Such connections provide for the securement of a display attachment in accordance with the present invention even though there is no conventional hatband in the headgear.

As best shown in FIG. 9, when a web connection 68 is released, the end of the released web is threaded through the U-shaped slit in a tab and the flap is tugged downwardly as before to align the strip adjacent head band or sweat band portion 66.

In like fashion, the other tab of the strip is connected with another web of the hat's webbing suspension to complete the installation for the attachment.

Since the web locations are fixed, the strip shown in FIG. 1 may not have tabs located in exactly the right locations. FIG. 2 illustrates an alternative strip 10*a* to that shown in FIG. 1 wherein tabs 12*a* and 14*a* are located some distance from the ends of strip 10*a* to form a center region 28*a* of the strip such a strip is sized so as to accommodate being secured in the headgear shown in FIGS. 7–9, as described above.

Now referring to FIG. 5, a side view of a headgear attachment is shown wherein the attachment has only a single flap 40 depending from strip 10. FIG. 6 illustrates an attachment having flaps 40 and 41, one flap being attached to either side of strip 10. In this embodiment, a separate image is included on the outside of flap 40 and the outside of flap 41. The wearer may first display the image presented by flap 40 and wear the other flap on top of his or her hair underneath the crown of the headgear. Thereafter, the wearer may reverse the arrangement to display the image of the other flap. Of course, the wearer may achieve much the same capability by having a flap with images on both sides of a single flap. This is because the strip itself is completely reversible. In either case, the strip is curled as it is appropriately inserted and released when in position, as previously discussed.

The pliability of the strip is important to the operation of the strip in that it can readily be curled by hand into a suitable arc. Also important is the tendency of the strip to straighten out because of its plastic memory or have ends that are biased outwardly when the strip is installed. The ribs included as part of the strip increase the stiffness and the plastic memory of the strip. This tendency keeps the strip in the position where it is supposed to be so that it does not rotate around on the hatband.

The top corners of the tabs are curvilinear to keep from poking the wearer's head. The connection areas between the tabs and the center portion of the strip are also similarly curvilinear to prevent the tabs from tearing off the strip. The holes at the ends of the U-shaped slits and the top rib along the outer edges of the tabs help prevent the slits from tearing out of the tabs.

The flap material is preferably cloth and is preferably double-knit cloth with its primary stretch direction being transverse to the long dimension of the strip. This not only allows the flap to drape in a desirable manner, but also makes easier the stitching of the flap to the strip.

If preferred, the flap can be of plastic or paper material, as desired. Either material for the flap should reduce the cost of manufacture.

The strip may also be made of cardboard or other paper material. For example, a strip can be made by folding a piece of paper over and over to build up of several layers. Such a strip will be somewhat compliant and will have the desirable tendency to straighten out, a desirable characteristic for the strip, as previously described.

While particular embodiments of the invention have been shown, it will be understood that the invention is not limited thereto. Many modification may be made and will become apparent to those skilled in the art. For example, the flap can include a pocket for accommodating an ice pack or the like to keep cool the neck of the wearer. Also, the flap could be worn in front with appropriate eye holes for masquerade purposes, if desired, rather than in the back.

What is claimed is:

1. A headgear attachment for attaching to a headgear having an arcuate hatband at least substantially encircling the inside periphery of the headgear, the hatband being attached at its lower edge to at least a substantial portion of the periphery of the headgear to form a top-opening arcuate pocket inside the headgear, the headgear attachment comprising a flat, linear and pliable strip that is biased toward its normally linear condition when put into an arcuate condition, said strip for laying against a substantial portion of the hatband inside the headgear, tabs projecting upward from said strip at least approximately near the opposite ends thereof, each of said tabs having a U-shaped slit forming a downwardly directed tongue, each of said tongues for fitting over the hatband into the pocket therebehind, and a flap attached to said strip and depending downwardly therefrom to cover a portion of the head of the wearer of the headgear not covered by the headgear itself.

2. A headgear attachment in accordance with claim 1, wherein each of said tabs is contiguous with said strip, the ends of each of said U-shaped slits terminating in substantially round holes for minimizing tear out of said slits through their respective tab.

3. A headgear attachment in accordance with claim 2, and including a rib near the top edge of each of said tabs to further minimize tear out of said slits through their respective tabs.

4. A headgear attachment in accordance with claim 2, wherein the ends of each of said U-shaped slits terminate in the center of a respective hole to form hooks at the sides of said tongues.

5. A headgear attachment in accordance with claim 1, wherein said tabs each have rounded corners to prevent sharp corners from poking the head of the wearer of the headgear.

6. A headgear attachment in accordance with claim 1, wherein said flap is attached to said strip by stitching to said strip.

7. A headgear attachment in accordance with claim 1, and including a bottom rib along the bottom edge of said strip and an intermediate rib parallel with said bottom rib and spaced apart therefrom, each of said bottom and intermediate ribs being thicker than said strip, said bottom and intermediate ribs increasing the stiffness and plastic memory of said strip.

8. A headgear attachment in accordance with claim 7, wherein said flap is attached to said strip by stitching to said strip between said bottom rib and said intermediate rib.

9. A headgear attachment in accordance with claim 7, wherein said bottom and intermediate ribs are the same thickness.

10. A headgear attachment in accordance with claim 1, and having curvilinear stabilizing junctions between the top edge of said strip and each of said tabs.

11. A headgear attachment in accordance with claim 1, wherein said flap is fabric.

12. A headgear in accordance with claim 11, and including a pocket on said flap for accommodating an ice pack.

13. A headgear attachment in accordance with claim 11, wherein said flap is made of double-knit fabric biased to stretch primarily in a direction transverse to the elongate dimension of said strip.

14. A headgear attachment in accordance with claim 1, wherein said flap is substantially paper.

15. A headgear attachment in accordance with claim 1 or 14, wherein said flap is attached to said strip by gluing.

16. A headgear attachment in accordance with claim 1, wherein said flap includes an image on the side thereof away from the head of the wearer.

17. A headgear attachment in accordance with claim 1, wherein said flap is reversible by having an image on both sides thereof.

18. A headgear attachment in accordance with claim 1, and having a second flap attached to said strip for folding into the inside top of said headgear when not exposed to view.

19. A headgear attachment in accordance with claim 1, wherein said edges of said flap are surged and trimmed to the final shape of said flap.

20. A headgear attachment in accordance with claim 1, wherein said strip is low density polyethylene.

21. A headgear attachment in accordance with claim 1, wherein said strip is substantially paper.

22. A headgear attachment for attaching to a headgear having a suspension webbing therein with a plurality of webs attached to an arcuate hatband, at least two of said webs being releasably attached to the suspension crown, the headgear attachment comprising a flat, linear and pliable strip that is biased toward its normally linear condition when put into an arcuate condition, said strip laying against a substantial portion of the hatband inside the headgear, tabs projecting upward from said strip at least approximately near the ends thereof, said tabs being spaced apart from each other at an arcuate distance so that said tabs are centered on two of the releasable webs, each of said tabs having a U-shaped slit forming a downwardly directed tongue, releasable ends of said two releasable webs being respectively threaded through said respective slits for attaching to the webbing to secure said strip to the headgear, and a flap attached to said strip and depending downwardly therefrom to cover a portion of the head of the wearer of the headgear not covered by the headgear itself.

23. The method of making a headgear attachment for attaching adjacent the hatband of a headgear, which comprises extruding a flat elongated pliable plastic strip that tends to straighten out when curled, stamping said strip to form two tabs by removing a substantial portion of said strip therebetween and so as to make the width of said strip between said tabs no greater than the hatband, cutting a U-shaped slit in each of said tabs to form downwardly directed tongues for attaching to the headgear to hold said strip against said hatband, and affixing a flap to said strip that hangs down therefrom to provide cover of at least a portion of the head of the wearer below the headgear.

24. The method of making a headgear attachment in accordance with claim 23, wherein said extruded strip included a top rib near its top edge where said tabs are to be formed.

25. The method of making a headgear attachment in accordance with claim 23, wherein said extruded strip includes a bottom rib along its bottom edge and a parallel immediate rib spaced therefrom below the places where said tabs are to be formed.

26. The method of making a headgear attachment in accordance with claim 25, and including stitching said flap of material to said strip between said bottom rib and said intermediate rib.

27. The method of making a headgear attachment in accordance with claim 23, wherein holes are made centered adjacent the ends of U-shaped slits to minimize tearing of the strip, to allow complete seating of the tongues to said hatband and to form hooks along said tongues for assisting in attaching said strip to said hatband.

28. The method of making a headgear attachment in accordance with claim 23, wherein said strip is low density polyethylene.

29. The making of a strip to which a flap is attachable to form a headgear attachment for attaching to the headgear, which comprises extruding a flat elongated pliable plastic strip that tends to straighten out when curled, stamping said strip to form two tabs by removing a substantial portion of said strip therebetween and so as to make the width of said strip between said tabs no greater than the hatband, and cutting a U-shaped slit in each of said tabs to form downwardly directed tongues for attaching to the headgear to hold said strip against said hatband.

* * * * *